US011807911B2

(12) United States Patent
Sun et al.

(10) Patent No.: US 11,807,911 B2
(45) Date of Patent: Nov. 7, 2023

(54) HEAT TREATMENT METHOD FOR TITANIUM-ALUMINUM INTERMETALLIC AND HEAT TREATMENT DEVICE THEREFOR

(71) Applicant: METAL INDUSTRIES RESEARCH & DEVELOPMENT CENTRE, Kaohsiung (TW)

(72) Inventors: Hong-Yuan Sun, Kaohsiung (TW); Chen-Hsueh Chang, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 0 days.

(21) Appl. No.: 17/551,251

(22) Filed: Dec. 15, 2021

(65) Prior Publication Data

US 2023/0183830 A1 Jun. 15, 2023

(51) Int. Cl.
*C21D 9/08* (2006.01)
*C22C 21/00* (2006.01)
*C22C 14/00* (2006.01)

(52) U.S. Cl.
CPC ..... *C21D 9/08* (2013.01); *C22C 14/00* (2013.01); *C22C 21/003* (2013.01)

(58) Field of Classification Search
None
See application file for complete search history.

(56) References Cited

U.S. PATENT DOCUMENTS 5,429,796 A * 7/1995 Larsen, Jr. ..... C22C 32/0073 420/421
H1659 H * 7/1997 Semiatin ..... 148/670
2010/0000706 A1* 1/2010 Renkel ..... B22D 21/005 164/114
2014/0369822 A1* 12/2014 Smarsly ..... C22F 1/183 148/670
2016/0265096 A1* 9/2016 Janschek ..... C22F 1/002
2017/0081751 A1* 3/2017 Janschek ..... C22C 21/00
2018/0016668 A1* 1/2018 Smarsly ..... C22F 1/183

FOREIGN PATENT DOCUMENTS

CN 100445415 C 12/2008
EP 2620517 A1 * 7/2013 ..... B22F 3/15

OTHER PUBLICATIONS

English language machine translation of EP-2620517-A1. Generated Feb. 3, 2023. (Year: 2023).*

* cited by examiner

*Primary Examiner* — Brian D Walck
(74) *Attorney, Agent, or Firm* — Juan Carlos A. Marquez; Marquez IP Law Office, PLLC

(57) ABSTRACT

A heat treatment method for a titanium-aluminum (TiAl) intermetallic includes the following steps: providing a TiAl intermetallic casting material; performing a first-stage heat treatment on the TiAl intermetallic casting material, where the TiAl intermetallic casting material is heated until a metallographic structure thereof is transformed into the α+γ phase, and is then cooled to room temperature to form a transitional casting material; and performing a second-stage heat treatment on the transitional casting material, where the transitional casting material is heated until a metallographic structure thereof is transformed into the α single phase, and is then cooled to room temperature to form a TiAl intermetallic.

4 Claims, 5 Drawing Sheets

HEAT TREATMENT METHOD FOR TITANIUM-ALUMINUM INTERMETALLIC AND HEAT TREATMENT DEVICE THEREFOR

BACKGROUND

Technical Field

The present disclosure relates to a heat treatment method for a titanium-aluminum (TiAl) intermetallic, and in particular, to a heat treatment method for a TiAl intermetallic with first-stage heat treatment and second-stage heat treatment, where a full lamella structure of the TiAl intermetallic heat-treated has smaller grains than a TiAl intermetallic casting material.

Related Art

Global automobile production keeps increasing. For the requirements of reducing fuel consumption and improving urban air quality, there is an increasing demand for engines with low energy consumption and high performance. A turbocharger can significantly increase engine power, improve emissions, and reduce fuel consumption. Therefore, it is a basic trend in modern automobile industry to use small engines with turbochargers to replace naturally aspirated engines. Turbine blades are subjected to high-temperature and high-pressure exhaust gas from engines. The highest temperature of exhaust gas emitted by diesel engines of passenger vehicles is about 850° C., and the temperature of exhaust gas emitted by gasoline engines may reach 1050° C. Impellers and turbines of turbochargers are not large in size, which generally have diameters not greater than 100 mm, but have a very high rotation speed, which is up to 250000 r/min. For continuous high-speed operation in severe operating environments, there are very high requirements for materials and performance. Therefore, it is very necessary to develop a material for rotors and blades of high-performance automobile engines.

Compared with other intermetallic compounds, a titanium-aluminum (TiAl) intermetallic has adequate comprehensive performance and has properties such as low density, high melting point, high oxidation resistance, and excellent high-temperature strength and rigidity. Moreover, the elastic modulus of the TiAl intermetallic is much higher than that of other structural materials, and the TiAl intermetallic used as a structural workpiece can significantly improve tolerance to high-frequency vibration. Compared with a nickel (Ni)-based alloy, the TiAl intermetallic further has better high-temperature creep resistance and good flame-retardant performance.

However, the TiAl intermetallic has low fracture toughness, low plasticity and poor high-temperature oxidation resistance, which are main bottlenecks limiting the use of the TiAl intermetallic. A general use temperature of the TiAl intermetallic is 680-750° C. When the use temperature exceeds 750° C., the oxidation resistance is obviously reduced. The TiAl intermetallic is limited by the poor high-temperature oxidation resistance at a high use temperature. On the one hand, the generation of oxidation products reduces bearing cross-sectional areas of components and ultimately limits the time for maintaining the integrity at the use temperature. On the other hand, during high-temperature heat exposure, high-concentration oxygen dissolves into an alloy surface to form a broken oxygen-rich layer, which greatly reduces the plasticity of the alloy.

The patent document (Patent Publication No. CN100445415C) discloses a heat treatment process for refining an interlamellar gap of a TiAl-based alloy, including two parts: pre-treatment and cyclic aging treatment. The cyclic aging treatment is performed in the $\alpha+\gamma$ dual-phase zone with specific steps as follows: Step 1: heat the TiAl-based alloy after pretreatment to a first temperature zone 1200±20° C. of the $\alpha+\gamma$ dual-phase zone, and then keep the temperature for 2-5 minutes. Step 2: heat the TiAl-based alloy after treatment in step 1 to a second temperature zone 1300±20° C. at a heating rate $vh=1.0*10^{-3}-2.0*10^{-1}$° C./s, and then keep the temperature for 15-30 minutes. Step 3: Cool the TiAl-based alloy after treatment in step 2 to the first temperature zone 1200±20° C. at a cooling rate $vc=1.0*10^{-3}-9.0*10^{-1}$° C./s, and then keep the temperature for 2-5 minutes. Step 4: Repeat step 2 and step 3 two to six times, then naturally cool the resulting TiAl-based alloy to room temperature, and take the cooled TiAl-based alloy out, to obtain the TiAl-based alloy with a refined interlamellar gap. The heat treatment process for refining an interlamellar gap of a TiAl-based alloy in the foregoing patent document is applicable for refining interlamellar gap of a TiAl-based alloy with an Al content of 45 at % to 51 at %, or for refining interlamellar spacing of a high-niobium (Nb) TiAl-based alloy with an Al content of 42 at % to 46 at % and an Nb content of 5 at % to 10 at %. In a heat treatment process of this patent document, a full-lamella TiAl-based alloy ingot that is cast or solidified is first subjected to homogenization and hot isostatic pressing, and is then subjected to cyclic aging in the $\alpha+\gamma$ dual-phase zone. The control of parameters corresponding to a heating rate, a cooling rate, a heat preservation temperature, a heat preservation time, etc. can effectively control and refine an interlamellar gap of the TiAl-based alloy structure, and maintain a macroscopic lamella morphology of the TiAl-based alloy. However, the heat treatment process for refining an interlamellar gap of a TiAl-based alloy disclosed in the foregoing patent is excessively complex.

Therefore, a heat treatment method for a TiAl intermetallic is required to resolve the foregoing problems.

SUMMARY

An objective of the present disclosure is to provide a heat treatment method for a titanium-aluminum (TiAl) intermetallic with first-stage heat treatment and second-stage heat treatment, where a full lamella structure of the TiAl intermetallic heat-treated has smaller grains than a TiAl intermetallic casting material.

According to the above objective, the present disclosure provides a heat treatment method for a titanium-aluminum (TiAl) intermetallic, comprising the following steps: providing a TiAl intermetallic casting material; performing a first-stage heat treatment on the TiAl intermetallic casting material, wherein the TiAl intermetallic casting material is heated until a metallographic structure thereof is transformed into the $\alpha+\gamma$ phase, and is then cooled to room temperature to form a transitional casting material; and performing a second-stage heat treatment on the transitional casting material, wherein the transitional casting material is heated until a metallographic structure thereof is transformed into the a single phase, and is then cooled to room temperature to form a TiAl intermetallic.

The present disclosure further provides a heat treatment device for a titanium-aluminum (TiAl) intermetallic, configured to implement the above-mentioned heat treatment method for a TiAl intermetallic, the device comprising: a heat treatment material pipe; a first furnace, movably disposed at one side of the heat treatment material pipe; and a second furnace, movably disposed at an the other side of the heat treatment material pipe; wherein the heat treatment material pipe selectively extends into the first furnace or the second furnace.

The full lamella structure (having the grain size <250 μm) of the TiAl intermetallic of the present disclosure has smaller grains than the TiAl intermetallic casting material (having the grain size of 1-3 mm), thereby having high strength, and good high-temperature creep resistance and low-temperature ductility.

DETAILED DESCRIPTION

Figure 1:
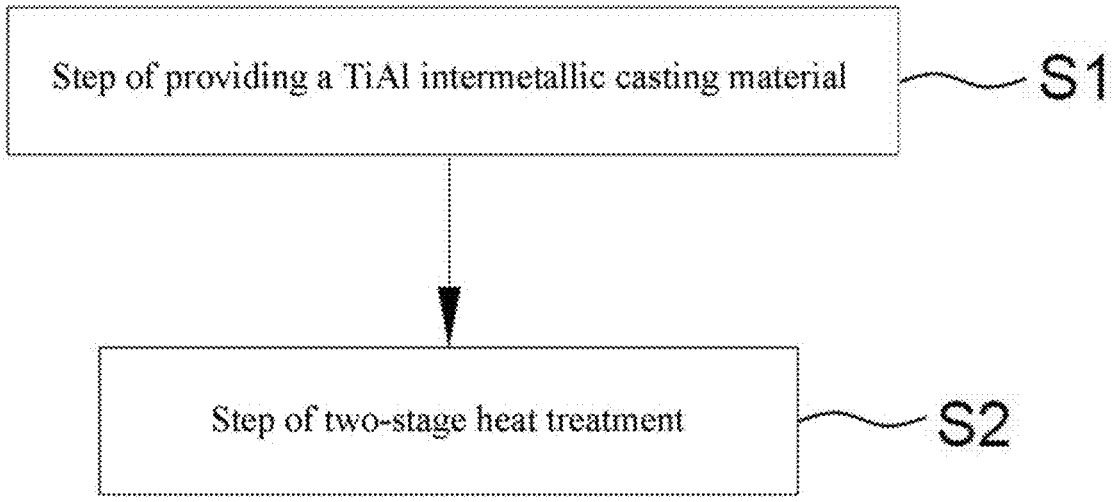
FIG. 1 is a flowchart of a heat treatment method for a titanium-aluminum (TiAl) intermetallic according to an embodiment of the present disclosure.

To make the foregoing objectives, features, and characteristics of the present disclosure more comprehensible, related embodiments of the present disclosure are described in detail below with reference to the accompanying drawings.

Embodiments of the present disclosure are described in detail below with reference to the accompanying drawings. The accompanying drawings are mainly simplified schematic diagrams, and only exemplify the basic structure of the present disclosure schematically. Therefore, only the components related to the present disclosure are shown in the drawings, and are not drawn according to the quantity, shape, and size of the components during actual implementation. During actual implementation, the specification and size of the components are actually an optional design, and the layout of the components may be more complex.

FIG. 1 is a flowchart of a heat treatment method for a titanium-aluminum (TiAl) intermetallic according to an embodiment of the present disclosure. The heat treatment method for a TiAl intermetallic mainly includes the following steps: step S1 of providing a TiAl intermetallic casting material; and step S2 of two-stage heat treatment. The step S1 of providing a TiAl intermetallic casting material may include smelting step: placing a plurality of smelting raw materials of the TiAl intermetallic in an induction smelting device, and melting the smelting raw materials into a molten TiAl intermetallic having casting fluidity; and casting and curing step: casting the molten TiAl intermetallic, to be cured into a TiAl intermetallic casting material. The step S2 of two-stage heat treatment includes: performing first-stage heat treatment and second-stage heat treatment on the TiAl intermetallic casting material, to form a TiAl intermetallic.

Figure 2:
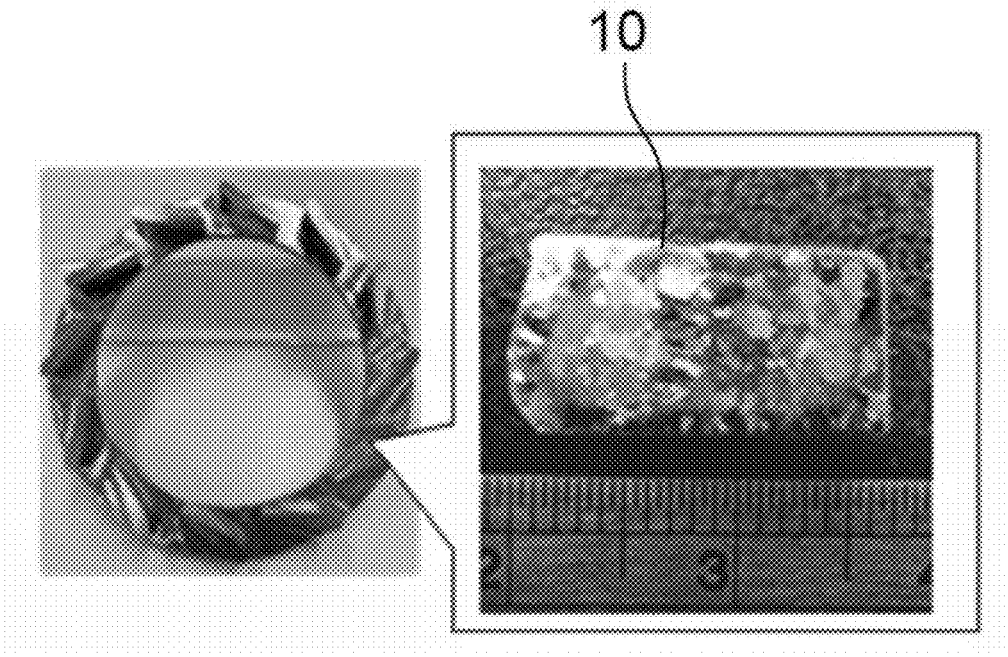
FIG. 2 is a cross-sectional view of a slice of a TiAl intermetallic casting material according to an embodiment of the present disclosure.

For example, during the smelting step of the present disclosure, after vacuumizing, smelting materials containing titanium (Ti), aluminum (Al), chromium (Cr), niobium (Nb), molybdenum (Mo), manganese (Mn), nickel (Ni), silicon (Si), iron (Fe), or boron (B) are placed in a vacuumized induction smelting device (e.g., a water-cooled copper crucible condensation shell smelting device) for vacuum smelting, so that the smelting materials are melted and mixed into a molten TiAl intermetallic with a specific ratios. For example, a vacuum degree is 102-104 torr, and an inert gas (argon or helium) is 0.3-0.7 MPa. The smelting materials containing Ti, Al, Cr, Nb, Mo, Mn, Ni, Si, Fe, or B include an aluminum-niobium alloy, titanium diboride, and the balance of pure elements. The smelting step is performed at a constant temperature of about 1550-1650° C. for 5-10 minutes. During the casting and curing step of the present disclosure, the molten TiAl intermetallic is cast (with a casting temperature of about 1550-1650° C.), and is then cooled to be cured into a TiAl intermetallic casting material 10 (as shown in FIG. 2). Therefore, the cured TiAl intermetallic casting material 10 includes the following elements in atomic percentage: Al: 40-50 at %, Cr: 1-8 at %, Nb: 1-8 at %, Mo: 1-5 at %, Mn: 1-6 at %, Ni+Si+Fe: 1-15 at %, B: 0.05-0.8 at %, and the balance of Ti and inevitable impurities. Specifically, after the foregoing smelting materials are placed in the induction smelting device to form the molten alloy, the molten alloy in the induction smelting device is sampled to measure atomic composition proportions, to determine that the atomic composition percentages of the molten TiAl intermetallic after melting and mixing are kept at: Al: 40-50 at %, Cr: 1-8 at %, Nb: 1-8 at %, Mo: 1-5 at %, Mn: 1-6 at %, Ni+Si+Fe: 1-15 at %, B: 0.05-0.8 at %, and the balance of Ti and inevitable impurities. Under the condition of Ni+Si+Fe: 1-15 at %, Ni≤8 at %, Si≤8 at %, and Fe≤8 at %. In this case, as shown in FIG. 2, a grain size of the TiAl intermetallic casting material 10 is about 1-3 mm.

Figure 3:
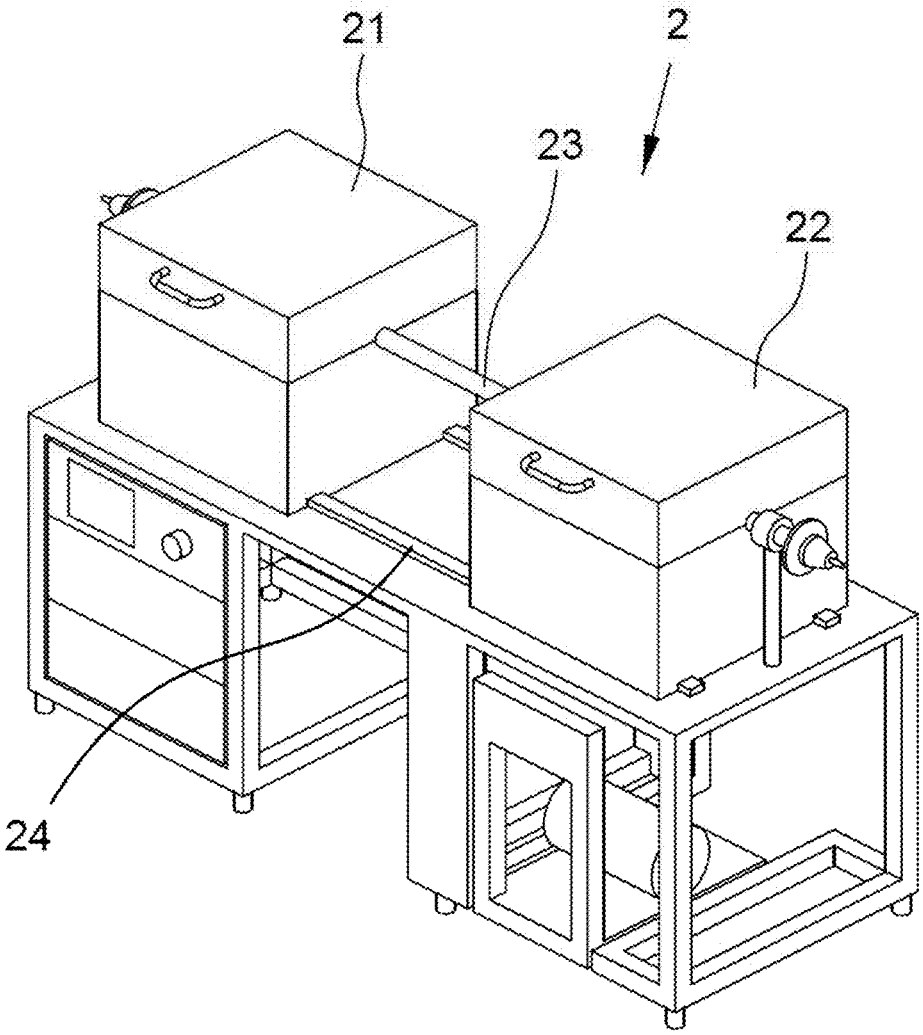
FIG. 3 is a schematic three-dimensional diagram of a heat treatment device for a TiAl intermetallic according to an embodiment of the present disclosure.
Figure 4:
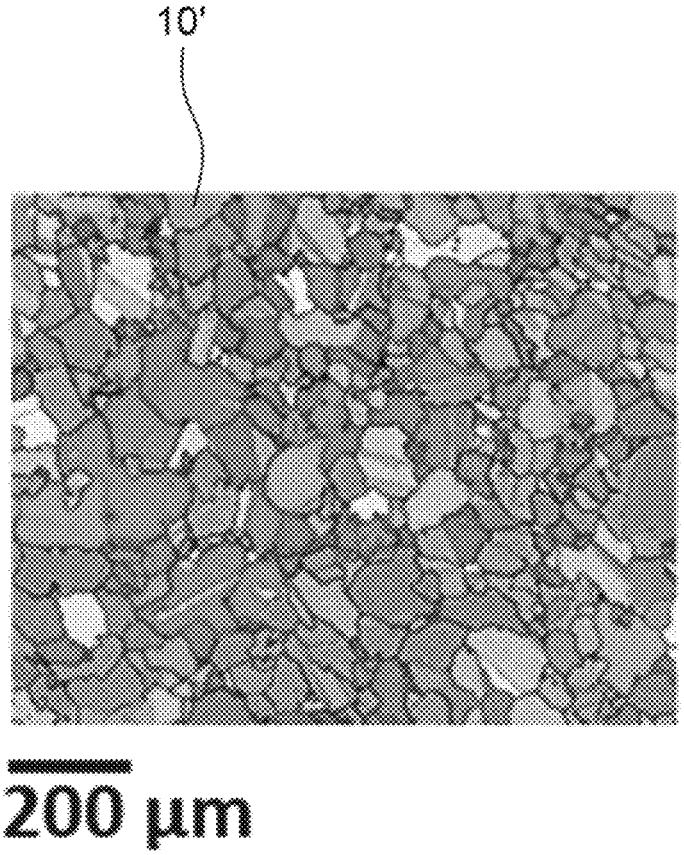
FIG. 4 is a micrograph of a metallographic structure of a TiAl intermetallic according to an embodiment of the present disclosure.

FIG. 3 is a schematic three-dimensional diagram of a heat treatment device for a TiAl intermetallic according to an embodiment of the present disclosure. A heat treatment device 2 for a TiAl intermetallic may be a double-furnace precision vacuum heat treatment furnace combining vacuum treatment with heat treatment. The heat treatment device 2 for a TiAl intermetallic is configured to implement the heat treatment method for a TiAl intermetallic, and includes: a heat treatment material pipe 23, a first furnace 21, and a second furnace 22. The first furnace 21 is movably disposed at one side of the heat treatment material pipe 23. The second furnace 22 is movably disposed at the other side of the heat treatment material pipe 23. The heat treatment material pipe 23 (made of quartz) selectively extends into the first furnace 21 or the second furnace 22, and a heat treatment temperature of the second furnace 22 is higher than a heat treatment temperature of the first furnace 21. In the step S2 of two-stage heat treatment of the present disclosure, the TiAl intermetallic casting material is placed in the heat treatment device 2 for a TiAl intermetallic for first-stage heat treatment and second-stage heat treatment, to form a TiAl intermetallic 10'. As shown in FIG. 4, a grain size of a metallographic structure of the TiAl intermetallic 10' is about ≤250 μm.

For example, when the first-stage heat treatment is performed, the first furnace 21 moves along a rail 24 to allow the heat treatment material pipe 23 filled with the TiAl intermetallic casting material to be located in the first furnace 21; and after the first-stage heat treatment is completed, the first furnace 21 moves to an initial position thereof. A metallographic structure of the TiAl intermetallic casting material is transformed into the α+γ phase through the first-stage heat treatment, and is then naturally cooled to room temperature to form a transitional casting material. Then, when the second-stage heat treatment is performed, the second furnace 22 moves along the rail to allow the heat treatment material pipe 23 filled with the TiAl intermetallic casting material to be located in the second furnace 22; and after the second-stage heat treatment is completed, the second furnace 22 moves to an initial position thereof. A metallographic structure of the transitional casting material is transformed into a single phase through the second-stage heat treatment, and is then naturally cooled to room temperature to form a TiAl intermetallic.

The first-stage heat treatment is from room temperature to a temperature range (1000-1250° C.) of the first-stage heat treatment. The temperature range of the first-stage heat treatment refers to a temperature range where the metallographic structure of the TiAl intermetallic casting material is transformed into the α+γ phase. A heat preservation time is 2-4 hours. Then, the furnace naturally cools down to room temperature. An objective of the first-stage heat treatment is to perform recrystallization in the α+γ phase zone (where the proportion of the γ phase is greater than that of the a phase) to make the γ phase stabilized, and has an effect of homogenization to make materials easy to process.

Figure 5:
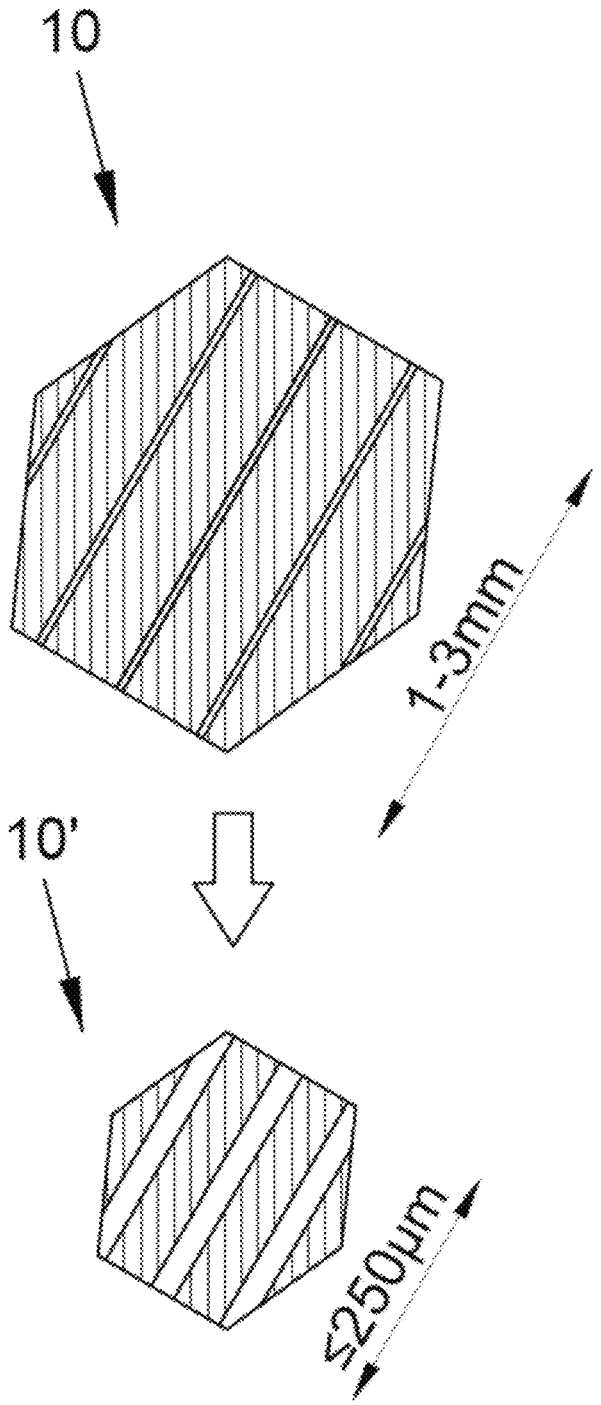
FIG. 5 is a schematic diagram of comparing differences between a grain size of a full lamella structure of a TiAl intermetallic and a grain size of a TiAl intermetallic casting material according to the present disclosure.

The second-stage heat treatment is from room temperature to a temperature range (1300-1450° C.) of the second-stage heat treatment. The temperature range of the second-stage heat treatment refers to a temperature range where the metallographic structure of the transitional casting material is transformed into the a single phase. A heat preservation time is 10-20 minutes. Then, the furnace naturally cools down to room temperature. An objective of the second-stage heat treatment is to transform the γ phase into the a phase for grain refinement, so as to obtain a full lamella structure through naturally cooling after heat preservation. As shown in FIG. 5, a full lamella structure of the TiAl intermetallic 10' has grains (with the grain size ≤250 μm) smaller than the TiAl intermetallic casting material 10 (with the grain size of 1-3 mm).

Figure 6:
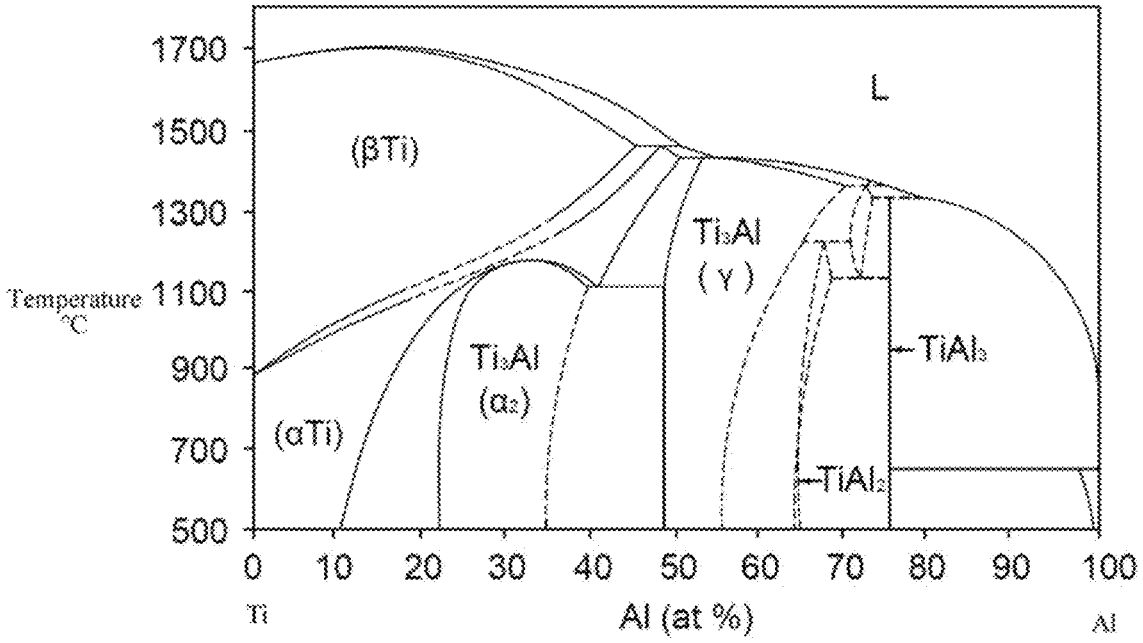
FIG. 6 is a Ti-Al binary phase diagram.

FIG. 6 is a Ti-Al binary phase diagram. Generally, a γ-TiAl superalloy has an Al content of 42-48 at %. The TiAl superalloy is of the α phase at a high temperature above 1300° C. The TiAl superalloy enters the α+γ dual-phase zone with decrease in temperature. The TiAl superalloy is of the $\alpha_2$+γ phase at a temperature below 1000° C. Therefore, if the temperature is reduced to the $\alpha_2$+γ dual-phase zone after the α single-phase heat treatment, a full lamella structure can be obtained. The obtained full lamella structure has excellent high-temperature creep resistance, but has poor ductility at room temperature caused by coarse grains. If the temperature is reduced to the $\alpha_2$+γ dual-phase zone after the α+γ dual-phase heat treatment, a lamella colony and a duplex structure of γ grains can be obtained. The obtained lamella colony and duplex structure of γ grains have poor high-temperature creep resistance, but have good ductility at room temperature due to small grains. In view of reasons of the coarse grains, in addition to a high growth rate of grains due to a high temperature of the a single-phase zone, the hexagonal close-packed (HCP) (0 0 0 1) plane of a is transformed into the quasi-face-centered cubic (FCC) (1 1 1) plane of γ during the phase transformation of $\alpha \rightarrow \alpha_2+\gamma$. Therefore, each α grain forms only a colony in a single lamella direction, that is, a size of the α grain directly determines a final colony size. If the FCC (1 1 1) plane of γ is first transformed into the HCP (0 0 0 1) plane of α, there will be variants in four directions, and an effect of grain refinement will be produced. Therefore, the heat treatment is first performed in the α+γ dual-phase zone, then the temperature is increased to slightly higher than the temperature of the α phase, and finally the temperature is reduced to the $\alpha_2$+γ dual-phase zone, so that a full lamella structure with small grains can be obtained. The refined full lamella structure has a large number of γ/γ double-grain boundaries and the $\alpha_2$/γ phase interfaces, which can effectively prevent the dislocation glide, thereby having high strength. Such a microstructure has good high-temperature creep resistance and low-temperature ductility.

Therefore, the full lamella structure (having the grain size ≤250 μm) of the TiAl intermetallic of the present disclosure has smaller grains than the TiAl intermetallic casting material (having the grain size of 1-3 mm), thereby having high strength, and good high-temperature creep resistance and low-temperature ductility.

In conclusion, preferred implementations or embodiments of the technical means adopted by the present disclosure to resolve the problems of the present disclosure are merely recorded, and are not intended to limit the scope of implementation of the present disclosure. That is, any equivalent changes and modifications literally conforming to the scope of the claims of the present disclosure or made according to the scope of the claims of the present disclosure shall fall within the scope of the present disclosure.

What is claimed is:

1. A heat treatment method for a titanium-aluminum (TiAl) intermetallic, comprising the following steps:

providing a TiAl intermetallic casting material;

performing a first-stage heat treatment on the TiAl intermetallic casting material, wherein the TiAl intermetallic casting material is heated until a metallographic structure thereof is transformed into an α+γ phase, and is then cooled to room temperature to form a transitional casting material; and performing a second-stage heat treatment on the transitional casting material, wherein the transitional casting material is heated until a metallographic structure thereof is transformed into an α single phase, and is then cooled to room temperature to form a TiAl intermetallic;

wherein a temperature range of the first-stage heat treatment refers to a temperature range where the metallographic structure of the TiAl intermetallic casting material is transformed into the α+γ phase, the temperature range of the first-stage heat treatment is 1000-1250° C. and a heat preservation time is 2-4 hours; and wherein a temperature range of the second-stage heat treatment refers to a temperature range where the metallographic structure of the transitional casting material is transformed into the α single phase, the temperature range of the second-stage heat treatment is 1300-1450° C., and a heat preservation time is 10-20 minutes.

2. The heat treatment method for a TiAl intermetallic according to claim 1, wherein a grain size of a full lamella structure of the TiAl intermetallic is ≤250 μm.

3. The heat treatment method for a TiAl intermetallic according to claim 1, wherein the step of providing a TiAl intermetallic casting material comprises: placing a plurality of smelting raw materials of the TiAl intermetallic in an induction smelting device, and melting the smelting raw materials into a molten TiAl intermetallic having casting fluidity; and casting the molten TiAl intermetallic, to be cured into the TiAl intermetallic casting material.

4. The heat treatment method for a TiAl intermetallic according to claim 3, wherein the TiAl intermetallic casting material comprises the following elements in atomic percentage: Al: 40-50 at %, Cr: 1-8 at %, Nb: 1-8 at %, Mo: 1-5 at %, Mn: 1-6 at %, Ni+Si+Fe: 1-15 at %, B: 0.05-0.8 at %, and the balance of Ti and inevitable impurities.

* * * * *